US010301070B2

(12) United States Patent
Tanaka et al.

(10) Patent No.: US 10,301,070 B2
(45) Date of Patent: May 28, 2019

(54) BOTTLE WITH HANDLE

(71) Applicant: YOSHINO KOGYOSHO CO., LTD., Tokyo (JP)

(72) Inventors: Toshimasa Tanaka, Tokyo (JP); Shigeru Tomiyama, Tokyo (JP)

(73) Assignee: YOSHINO KOGYOSHO CO., LTD., Tokyo (JP)

( * ) Notice: Subject to any disclaimer, the term of this patent is extended or adjusted under 35 U.S.C. 154(b) by 0 days.

(21) Appl. No.: 15/590,440

(22) Filed: May 9, 2017

(65) Prior Publication Data

US 2018/0297748 A1 Oct. 18, 2018

(30) Foreign Application Priority Data

Apr. 13, 2017 (JP) ..... 2017-079860

(51) Int. Cl.
*B65D 23/10* (2006.01)
*B65D 1/02* (2006.01)
*B65D 1/42* (2006.01)

(52) U.S. Cl.
CPC ..... *B65D 23/10* (2013.01); *B65D 1/0246* (2013.01); *B65D 1/0276* (2013.01); *B65D 1/42* (2013.01)

(58) Field of Classification Search
CPC .... B65D 23/106; B65D 23/104; B65D 23/10; B65D 23/102; B65D 11/24; B65D 11/22; B65D 11/20; B65D 1/0246; B65D 1/023; B65D 1/0223; B65D 1/0276; B65D 1/0261; B65D 1/44; B65D 1/42; B65D 1/40
USPC ... 215/371, 373, 372, 384, 383, 382, 44, 43; 220/608, 604, 623, 610, 672, 670, 669, 220/675, 771, 770, 769; D9/570, 569
See application file for complete search history.

(56) References Cited

U.S. PATENT DOCUMENTS

D225,101 S * 11/1972 Marchetti ..... D9/527
4,170,622 A * 10/1979 Uhlig ..... B29C 49/18 215/371
4,993,565 A * 2/1991 Ota ..... B65D 23/102 215/384
5,381,910 A * 1/1995 Sugiura ..... B65D 1/0223 215/374
5,535,901 A * 7/1996 Ishii ..... B65D 23/106 215/396
D379,763 S * 6/1997 Ewing, Jr. ..... D9/520
D382,485 S * 8/1997 Krishnakumar ..... D9/543
(Continued)

FOREIGN PATENT DOCUMENTS

EP 437620 A1 * 7/1991 ..... B65D 1/02
JP H10-338220 A 12/1998
JP 2010052811 A * 3/2010 ..... B65D 1/02

*Primary Examiner* — Robert J Hicks
(74) *Attorney, Agent, or Firm* — Oliff PLC

(57) ABSTRACT

Provided is a bottle with a handle including a bottle in which a mouth portion, a body portion, and a bottom portion are continuously provided in this order along a direction of a bottle axis, and a handle disposed in a rear part of the bottle, wherein a first circumferential groove extending in a circumferential direction along the bottle axis is formed in a lower body portion of the body portion located between the handle and the bottom portion along the direction of the bottle axis, and the first circumferential groove is disposed over the entire region in the circumferential direction in a portion of the bottle along the circumferential direction in which the handle is located.

6 Claims, 3 Drawing Sheets

(56) References Cited

U.S. PATENT DOCUMENTS

| | | | | | |
|---|---|---|---|---|---|
| 5,704,506 | A * | 1/1998 | Tobias | B29C 66/1122 | 215/398 |
| 5,833,115 | A * | 11/1998 | Eiten | B65D 1/0223 | 206/509 |
| 6,112,925 | A * | 9/2000 | Nahill | B65D 1/0215 | 215/381 |
| 6,206,218 | B1 * | 3/2001 | Young | B65D 21/0204 | 220/23.4 |
| 7,000,793 | B2 * | 2/2006 | Roubal | B65D 1/0276 | 215/373 |
| 7,185,777 | B2 * | 3/2007 | Itokawa | B65D 1/0223 | 215/381 |
| 8,739,995 | B2 * | 6/2014 | Sasaki | B65D 1/0223 | 215/379 |
| 2005/0035084 | A1 * | 2/2005 | Simpson, Jr. | B65D 1/0223 | 215/396 |
| 2005/0067370 | A1 * | 3/2005 | Tanaka | B65D 1/0223 | 215/382 |
| 2005/0082251 | A1 * | 4/2005 | Darr | B65D 23/106 | 215/396 |
| 2007/0095785 | A1 * | 5/2007 | Ishikawa | B65D 23/106 | 215/398 |
| 2013/0001234 | A1 * | 1/2013 | Glover | B29C 49/48 | 220/606 |
| 2017/0368518 | A1 * | 12/2017 | Drake | B65D 1/44 | |

* cited by examiner

BOTTLE WITH HANDLE

FIELD OF THE INVENTION

The present invention relates to a bottle with a handle.

Priority is claimed on Japanese Patent Application No. 2017-079860, filed Apr. 13, 2017, the content of which is incorporated herein by reference.

DESCRIPTION OF RELATED ART

Conventionally, for example, as illustrated in Japanese Unexamined Patent Application, First Publication No. 2008-126266, a bottle with a handle including a bottle in which a mouth portion, a body portion, and a bottom portion are consecutively provided from an upper side to a lower side along a direction of a bottle axis in this order, and a handle disposed in a rear part of the bottle is known.

DOCUMENT LIST

Patent Document

[Patent Document 1]

Japanese Unexamined Patent Application, First Publication No. H10-338220

SUMMARY OF INVENTION

Technical Problem

However, in a conventional bottle with a handle, there is a possibility that, when a large axial force in a compression direction is applied to the mouth portion, since the handle exerts a rib effect, an upper body portion on which the handle is disposed may become inclined and fall forward with respect to a bottom body portion of the body portion located between the handle and the bottom portion along the direction of the bottle axis. In this case, there is a possibility that stress concentration points may be generated in the bottle and plastic deformation is likely to occur, that is, the buckling strength may be degraded.

The present invention has been made in view of the above-described circumstances, and an object of the present invention is to provide a bottle with a handle in which the upper body portion can be prevented from becoming inclined and falling forward with respect to the lower body portion, when a large axial force in a compressing direction is applied to a mouth portion.

Solution to Problem

The present invention adopts the following means in order to solve the above problem. That is, a bottle with a handle of the present invention includes a bottle in which a mouth portion, a body portion, and a bottom portion are continuously connected in this order along a direction of a bottle axis, and a handle disposed in a rear part of the bottle, wherein a first circumferential groove extending in a circumferential direction along the bottle axis is formed in a lower body portion of the body portion located between the handle and the bottom portion along the direction of the bottle axis, and the first circumferential groove is disposed over the entire region in the circumferential direction in a portion of the bottle along the circumferential direction in which the handle is located.

In the present invention, since the first circumferential groove formed in the lower body portion is disposed over the entire region in the circumferential direction of a portion (hereinafter referred to as a vertical rib region) of the bottle along the circumferential direction in which the handle is located, when a large axial force in the compression direction is applied to the mouth portion, a portion of the lower body portion located in the vertical rib region is easily compressed and deformed in the direction of the bottle axis so that the groove width of the first circumferential groove becomes narrower. Therefore, when a large axial force in the compression direction is applied to the mouth portion, even if the handle exerts a rib effect, it is possible to suppress the upper body portion from being inclined to fall forward with respect to the lower body portion.

Here, the lower body portion may include a front wall, a rear wall, and a pair of left and right side walls, and may have a rectangular shape in a cross-sectional view orthogonal to the bottle axis, and the first circumferential groove may separately extend from the rear wall to the pair of left and right side walls.

In this case, since the first circumferential groove separately extends from the rear wall of the lower body portion to the pair of left and right side walls, and crosses the corner portions located at the connecting portions between the rear wall and the side walls in the circumferential direction, when a large axial force in the compression direction is applied to the mouth portion, the connecting portion originally having high rigidity with respect to such an axial force is easily compressed and deformed in the axial direction such that the groove width of the first circumferential groove is narrowed. Therefore, it is possible to suppress an occurrence of a portion in which stress is concentrated due to the fact that, when a large axial force in the compression direction is applied to the mouth portion, the connecting portion in the lower body portion is not easily compressed and deformed in the direction of the bottle axis, and it is possible to improve the buckling strength.

Further, the side wall may include a main plate portion, and a pair of front and rear angular plate portions which separately connect the main plate portion, the rear wall, and the front wall, and the first circumferential groove may extend from the rear wall to the main plate portion via the angular plate portions.

In this case, since the first circumferential groove extends from the rear wall to the main plate portion via the angular plate portion on the side walls, when a large axial force in the compression direction is applied to the mouth portion, it is easy to compress and deform the connecting portion in the direction of the bottle axis so as to narrow the groove width of the first circumferential groove over the entire circumference, and it is possible to reliably improve the buckling strength.

Further, a second circumferential groove extending in the circumferential direction may be formed between the upper body portion of the body portion in which the handle is disposed and the lower body portion, at a position avoiding a portion of the bottle along the circumferential direction in which the handle is positioned.

In this case, since the second circumferential groove is formed at the position avoiding the vertical rib region between the upper body portion and the lower body portion, when a large axial force in the compression direction is applied to the mouth portion, it is possible to compress and deform the body portion in the direction of the bottle axis so as to narrow the groove width of the second circumferential groove, since the first circumferential groove is formed in a portion of the lower body portion located in the vertical rib region, it is easy to uniformly compress and deform the body portion in the direction of the bottle axis over the entire circumference, and it is possible to suppress the upper body portion from being inclined to fall forward with respect to the lower body portion.

Further, the first circumferential groove may be disposed at a position avoiding a portion of the bottle along the circumferential direction in which the second circumferential groove is located.

In this case, when a large axial force in the compression direction is applied to the mouth portion, it is possible to easily and uniformly compress and deform the body portion in the direction of the bottle axis over the entire circumference.

Further, a recessed portion which is recessed forward and in which the handle is disposed may be formed in a rear part of the upper body portion, and each of both end portions of the second circumferential groove in the circumferential direction may open to the recessed portion.

In this case, the handle is disposed in the recessed portion formed in the rear part of the upper body portion, and when a large axial force in the compression direction is applied to the mouth portion, since the rib effect of the handle is easily exerted, it is possible to significantly exert the aforementioned actions and effects.

Further, since both end portions of the second circumferential groove in the circumferential direction open to the recessed portion, when a large axial force in the compression direction is applied to the mouth portion, the body portion can be reliably compressed and deformed in the direction of the bottle axis so as to narrow the width of the second circumferential groove.

Effects of the Invention

According to the present invention, when a large axial force in a compressing direction is applied to a mouth portion, it is possible to suppress the upper body portion from being inclined to fall forward with respect to the lower body portion.

DESCRIPTION OF EMBODIMENTS

Hereinafter, an embodiment of the present invention will be described with reference to the drawings.

Figure 1:
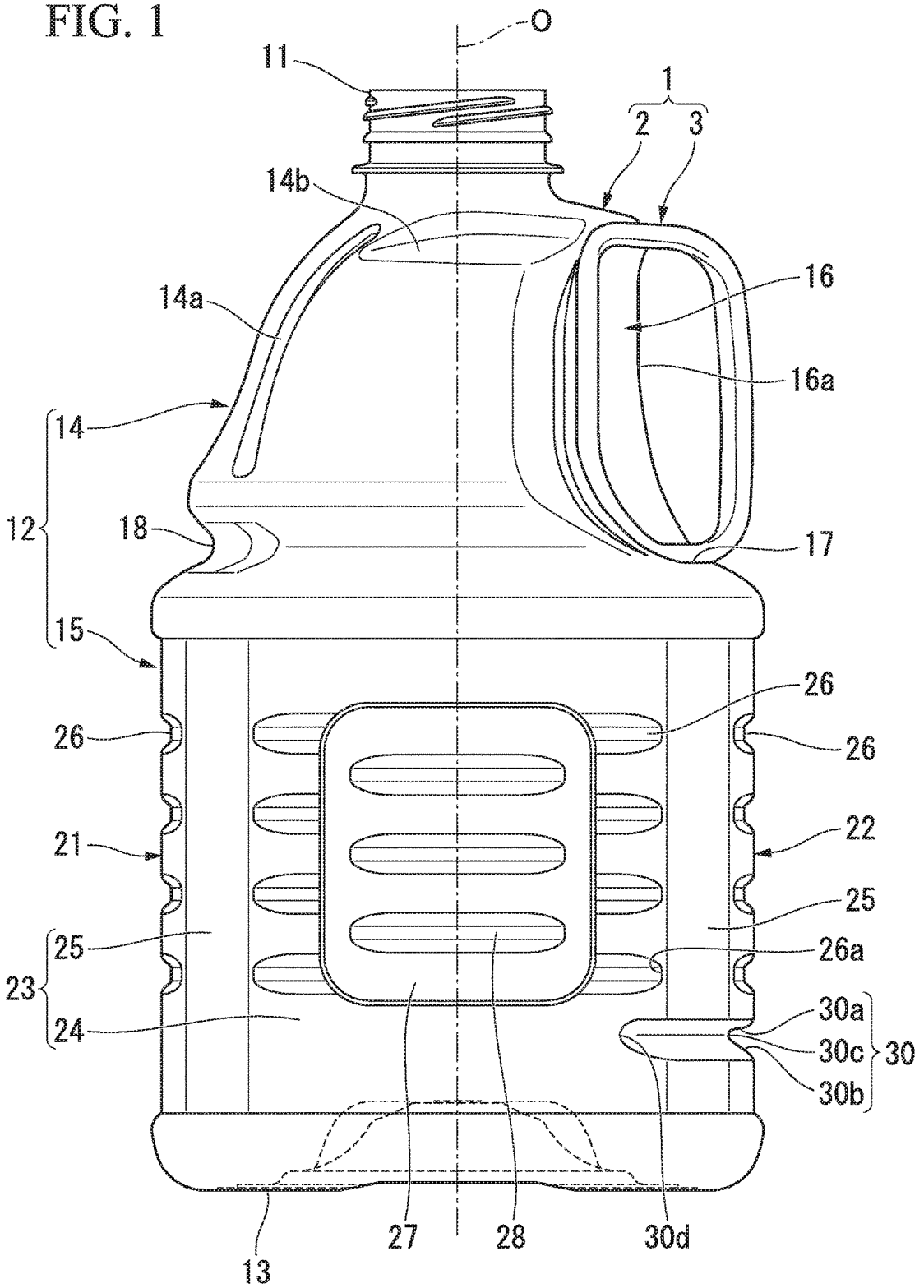
FIG. 1 is a side view of a bottle with a handle illustrated as an embodiment according to the present invention as viewed from a left-right direction.
Figure 2:
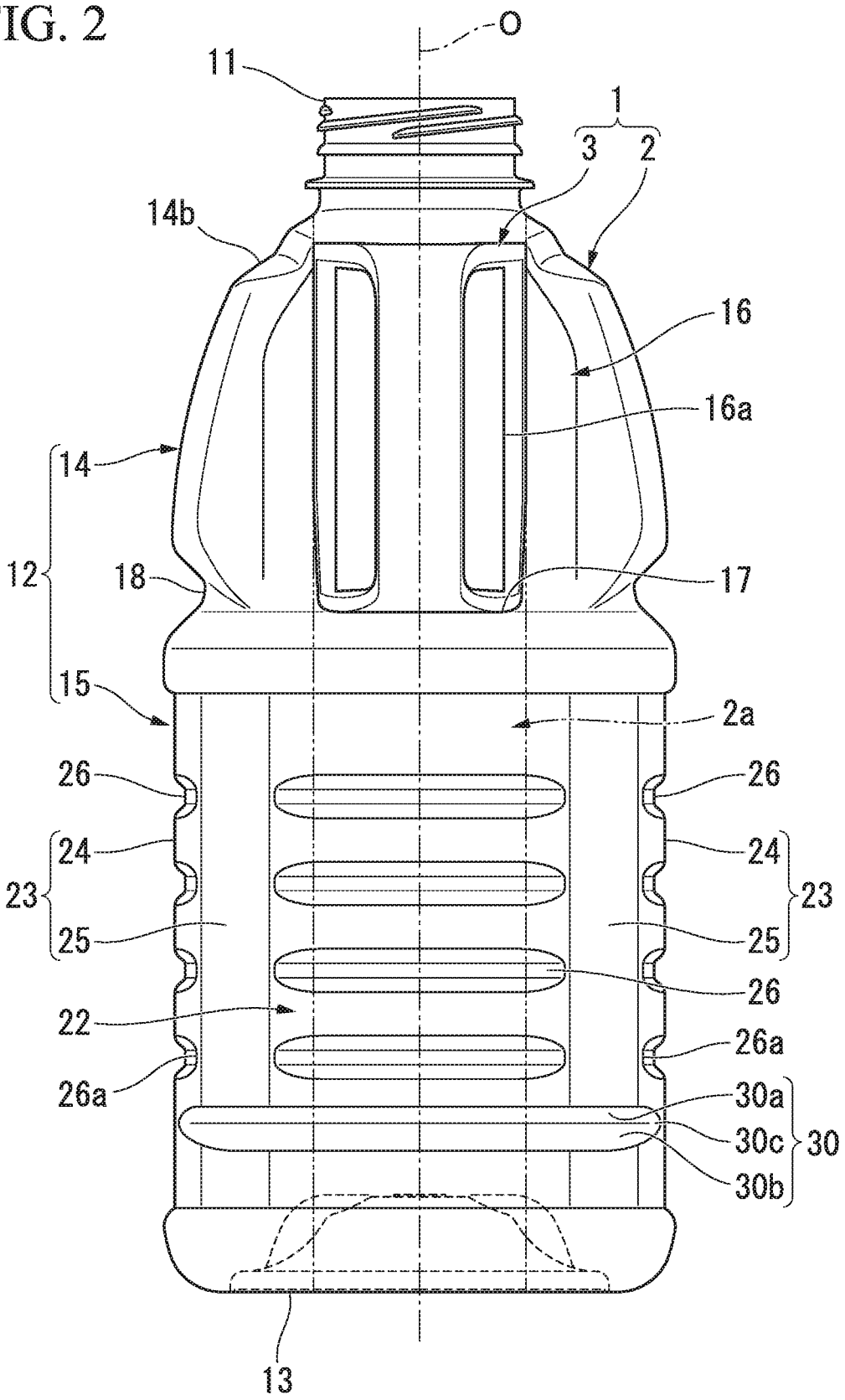
FIG. 2 is a rear view of the bottle with the handle illustrated in FIG. 1 as viewed from the rear part.
Figure 3:
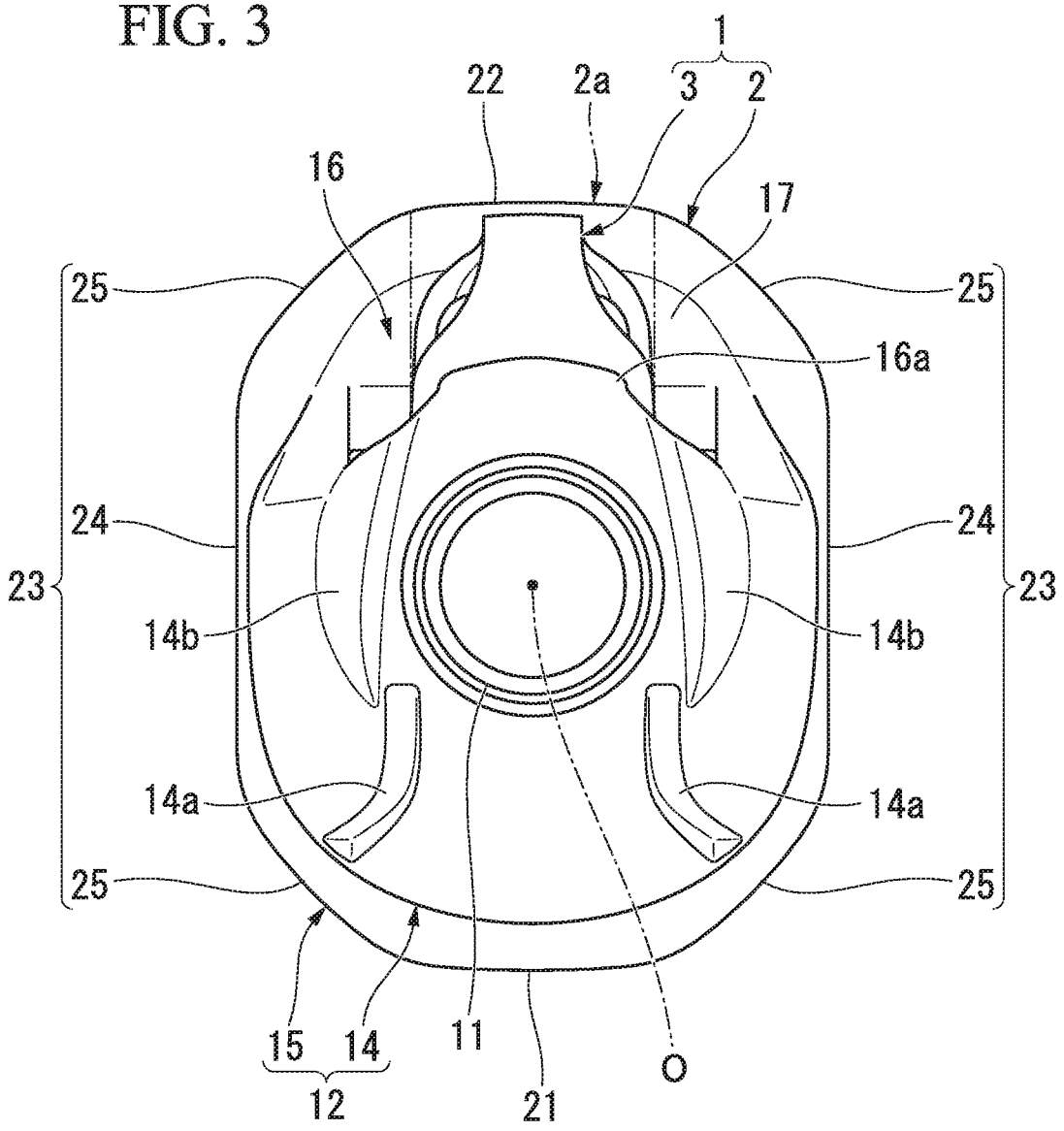
FIG. 3 is a top view of the bottle with the handle illustrated in FIG. 1.

In a bottle with a handle 1 according to the present embodiment, as illustrated in FIGS. 1, 2 and 3, a bottle 2 in which a mouth portion 11, a body portion 12, and a bottom portion 13 are continuously connected in this order in the direction of a bottle axis O, and a handle 3 disposed on the bottle 2 are provided.

Hereinafter, a side of the mouth portion 11 along the direction of the bottle axis O is referred to as an upper side, and a side of the bottom portion 13 is referred to as a lower side. Further, a direction orthogonal to the bottle axis O when viewed from the direction of the bottle axis O is referred to as a radial direction, and a circumferential direction around the bottle axis O is referred to as a circumferential direction. Also, when viewed from the direction of the bottle axis O, a side on which the handle 3 is located with respect to the mouth portion 11 is referred to as a rear side, a side opposite thereto is referred to as a front side, and a direction orthogonal to the front-rear direction is referred to as a left-right direction.

The mouth portion 11 is formed in a cylindrical shape and is arranged coaxially with the bottle axis O. A male screw portion is formed on the outer circumferential surface of the mouth portion 11.

The body portion 12 includes an upper body portion 14 on which the handle 3 is disposed, and a lower body portion 15 located between the handle 3 and the bottom portion 13.

In the illustrated example, the size of the upper body portion 14 in the direction of the bottle axis O is smaller than the size of the lower body portion 15 in the direction of the bottle axis O. As illustrated in FIG. 1, the size of the upper body portion 14 in the front-rear direction is smaller than the size of the lower body portion 15 in the front-rear direction. As illustrated in FIG. 2, the sizes of each of the upper body portion 14 and the lower body portion 15 in the left-right direction are equal to each other.

Further, the size of the upper body portion 14 in the direction of the bottle axis O may be equal to or greater than the size of the lower body portion 15 in the direction of the bottle axis O. The size of the upper body portion 14 in the front-rear direction may be equal to or greater than the size of the lower body portion 15 in the front-rear direction. Further, the sizes of each of the upper body portion 14 and the lower body portion 15 in the left-right direction may be different from each other.

In the rear part of the upper body portion 14, a recessed portion 16 which is recessed forward and in which the handle 3 is disposed is formed.

On the bottom surface of the inner surface defining the recessed portion 16 facing rearward, a support protrusion **16*a* protruding rearward is formed. The support protrusion 16*a* is disposed at the center portion in the left-right direction on the bottom surface of the recessed portion 16, and is disposed over the entire length of the bottom surface of the recessed portion 16 in the direction of the bottle axis O. A gap in the front-rear direction is separately provided between both end portions of the support protrusion 16*a* in the left-right direction and the bottom surface of the recessed portion 16, and by inserting a pair of left and right engaged portions of the handle 3 into each of the gaps, the handle 3 is disposed in a state of being fixed to the recessed portion 16. The recessed portion 16 is integrally opened in both the left-right direction and in the upper portion. The handle 3 is fixed to the recessed portion 16**, for example, by insert molding.

The body portion 12 includes a stepped portion 17 which connects the lower end portion of the bottom surface of the recessed portion 16 to the upper end portion of the lower body portion 15 and has an upper surface facing upward. The lower end portion of the handle 3 abuts on the upper surface of the stepped portion 17. A portion of the upper body portion 14 excluding the rear part gradually extends toward the inner side in the radial direction from the lower side to the upper side, and is formed into a curved surface shape protruding outward in the radial direction.

As illustrated in FIGS. 1 and 3, in the front part of the upper body portion 14, two vertical grooves **14*a* extending in the direction of the bottle axis O are formed with an interval therebetween in the left-right direction. The vertical grooves 14***a* are disposed over the entire region of the upper body portion 14 in the direction of the bottle axis O.

In the upper end portion of the upper body portion 14, hollow portions 14*b* recessed downward are formed separately in portions located on both sides while sandwiching the mouth portion 11 in the left-right direction. The hollow portions 14*b* are integrally opened toward both the front-rear direction and the outer side in the radial direction. The upper end portion of the vertical grooves 14*a* is located above the bottom surface of the hollow portion 14*b* and below the upper end edge of the hollow portion 14*b*. The upper end portions of the vertical grooves 14*a* are located inside the hollow portion 14*b* in the left-right direction. The shape of the hollow portion 14*b* in a top view is a semicircular shape which includes a circular arc portion having a curved shape protruding outward in the left-right direction, and a chord portion connecting both circumferential ends in the circular arc portion and extending in the front-rear direction. Both end portions of the hollow portion 14*b* in the front-rear direction gradually shorten in length in the left-right direction toward the outer side in the front-rear direction.

As illustrated in FIGS. 1 and 2, between the upper body portion 14 and the lower body portion 15, a main groove (second circumferential groove) 18 extending in the circumferential direction is formed at a position avoiding a portion (hereinafter referred to as vertical rib region) 2*a* of the bottle 2 along the circumferential direction in which the handle 3 is located. Both end portions of the main groove 18 in the circumferential direction are opened to the recessed portion 16, respectively. The inclination angles of a pair of upper and lower inner surfaces defining the main groove 18 with respect to a horizontal plane orthogonal to the bottle axis O are equal to each other. The respective inclination angles of the pair of upper and lower inner surfaces defining the main groove 18 with respect to the horizontal plane may be different from each other. Further, the shape of the main groove 18 in the vertical cross-section along the bottle axis O may be arbitrarily changed, for example, such as an arc shape.

The lower body portion 15 includes a front wall 21, a rear wall 22, and a pair of left and right side walls 23, and also has a rectangular shape in a cross-sectional view orthogonal to the bottle axis O. The lower body portion 15 is disposed coaxially with the bottle axis O.

The side walls 23 include a main plate portion 24, and a pair of front and rear angular plate portions 25 which separately connect the main plate portion 24, the rear wall 22, and the front wall 21. As illustrated in FIG. 3, the length of the angular plate portion 25 in the circumferential direction is shorter than the length of the main plate portion 24 in the circumferential direction, but the length of the angular plate portion 25 in the circumferential direction may be set to be equal to or longer than the length of the main plate portion 24 in the circumferential direction. Further, although the length of the angular plate portion 25 in the circumferential direction is equal to the length of each of the front wall 21 and the rear wall 22 in the circumferential direction, the length of the angular plate portion 25 in the circumferential direction may be set to be different from the lengths of each of the front wall 21 and the rear wall 22 in the circumferential direction.

The main plate portion 24 of the side wall 23 extends in a straight line in the front-rear direction in the cross-sectional view. The front wall 21 and the rear wall 22 straightly extend in the left-right direction in the cross-sectional view. Although the length of the main plate portion 24 in the front-rear direction is set to be longer than the lengths of each of the front wall 21 and the rear wall 22 in the left-right direction, the length of the main plate portion 24 in the front-rear direction may be set to be equal to or smaller than the lengths of each of the front wall 21 and the rear wall 22 in the left-right direction. Each connecting portion of the angular plate portion 25 of the side wall 23, the front wall 21, the rear wall 22, and the main plate portion 24 of the side wall 23 has corner portions formed in a curved surface shape protruding radially outward.

As illustrated in FIGS. 1 and 2, in the front wall 21, the rear wall 22, and the main plate portion 24 of the side wall 23, a plurality of first horizontal grooves 26 extending in the circumferential direction are formed at intervals in the direction of the bottle axis O. The first horizontal grooves 26 are arranged over the entire circumferences of the front wall 21, the rear wall 22, and the main plate portion 24 of the side wall 23. The respective positions of the plurality of first horizontal grooves 26 formed in each of the front wall 21, the rear wall 22, and the main plate portion 24 of the side wall 23 along the direction of the bottle axis O are equal in all of the front wall 21, the rear wall 22 and the main plate portion 24 of the side wall 23.

In the central portion of the main plate portion 24, a decompression absorbing panel portion 27 recessed radially inward is formed. The decompression absorbing panel portion 27 divides the plurality of first horizontal grooves 26 formed in the main plate portion 24 in the circumferential direction. In the decompression absorbing panel portion 27, a plurality of second horizontal grooves 28 extending in the circumferential direction are formed at intervals in the direction of the bottle axis O. The second horizontal grooves 28 are disposed at a position avoiding each position along the direction of the bottle axis O in which the plurality of first horizontal grooves 26 are located.

In the present embodiment, a first circumferential groove 30 extending in the circumferential direction is formed in a portion of the lower body portion 15 located in the vertical rib region 2*a*. The first circumferential groove 30 is disposed over the entire region in the circumferential direction in the vertical rib region 2*a*.

The groove width of the first circumferential groove 30 is narrower than the groove width of the main groove 18, and is equal to the groove widths of each of the first horizontal groove 26 and the second horizontal groove 28. The depth of the first circumferential groove 30 is shallower than the depth of the main groove 18, is deeper than the respective depths of the first horizontal groove 26 and the second horizontal groove 28, and is, for example, about 4 mm or more. Among the inner surfaces defining the first circumferential groove 30, the upper surface 30*a* located on the upper side and facing downward has an inclination angle with respect to the horizontal plane orthogonal to the bottle axis O smaller than the lower surface 30*b* located on the lower side and facing upward. The upper surface 30*a* and the lower surface 30*b* of the inner surface of the first circumferential groove 30 gradually extend toward each other in the direction of the bottle axis O from the outer side toward the inner side in the radial direction. Among the inner surfaces defining the first circumferential groove 30, the bottom surface 30*c* positioned at the inner end portion in the radial direction and facing outward in the radial direction is formed in a concave curved surface shape recessed inward in the radial direction.

The size relations between the first circumferential groove 30, the main groove 18, the first horizontal groove 26, and the second horizontal groove 28 are not limited to the aforementioned relations, and may be appropriately changed. Further, the shape of the first circumferential groove 30 in the vertical cross-section along the bottle axis O may be arbitrarily changed, for example, to a circular arc shape.

The first circumferential groove 30 is formed at the lower end portion of the lower body portion 15. The first circumferential groove 30 may be formed, for example, at the upper end portion, the central portion in the direction of the bottle axis O, or the like, without being limited to the lower end portion of the lower body portion 15.

The first circumferential groove 30 separately extends from the rear wall 22 to a pair of left and right side walls 23. As illustrated in FIG. 1, the first circumferential groove 30 extends from the rear wall 22 to the main plate portion 24 via the angular plate portion 25. Both end edges 30*d* of the first circumferential groove 30 in the circumferential direction are located in front of the rear end edge 26*a* between both end edges in the circumferential direction of the first horizontal groove 26 formed on the side wall 23. Both end edges 30*d* of the first circumferential groove 30 in the circumferential direction are located in front of the rear end portion of a portion, which abuts on the stepped portion 17 of the body portion 12, of the lower end portion of the handle 3. The first circumferential groove 30 is disposed at a position avoiding a portion of the bottle 2 along the circumferential direction in which the main groove 18 is located. In the bottle 2, a portion along the circumferential direction in which the first circumferential groove 30 is located may overlap a portion along the circumferential direction in which the main groove 18 is located.

A gap in the direction of the bottle axis O between the first horizontal groove 26 located at the lowermost part among the plurality of first horizontal grooves 26 and the first circumferential groove 30 is narrower than a gap in the direction of the bottle axis O between the first horizontal grooves 26 adjacent to each other in the direction of the bottle axis O, and a groove width of the first circumferential groove 30. The circumferential center portions of each of the first circumferential groove 30 and the vertical rib regions 2*a*, that is, the handle 3 are coincident with each other.

As described above, with the bottle with the handle 1 according to the present embodiment, the first circumferential groove 30 formed in the lower body portion 15 is disposed over the entire region in the circumferential direction of the vertical rib region 2*a*. Accordingly, when a large axial force in the compression direction is applied to the mouth portion 11, a portion of the lower body portion 15 located in the vertical rib region 2*a* is easily compressed and deformed in the direction of the bottle axis O so that the groove width of the first circumferential groove 30 becomes narrower. Therefore, even when a large axial force in the compression direction is applied to the mouth portion 11, even if the handle 3 exerts a rib effect, it is possible to suppress the upper body portion 14 from being inclined to fall forward with respect to the lower body portion 15.

Further, since the first circumferential groove 30 separately extends from the rear wall 22 of the lower body portion 15 to the pair of left and right side walls 23, and crosses the corner portions located at the connecting portion between the rear wall 22 and the side wall 23 in the circumferential direction, when a large axial force in the compression direction is applied to the mouth portion 11, the connecting portion originally having high rigidity with respect to such axial force is easily compressed and deformed in the direction of axis O to narrow the groove width of the first circumferential groove 30. Therefore, it is possible to suppress an occurrence of a portion in which stress is concentrated due to the fact that, when a large axial force in the compression direction is applied to the mouth portion 11, the connecting portion in the lower body portion 15 is not easily compressed and deformed in the direction of the bottle axis O, and it is possible to improve the buckling strength.

Further, since the first circumferential groove 30 extends from the rear wall 22 to the main plate portion 24 via the angular plate portion 25 on the side wall 23, when a large axial force in the compression direction is applied to the mouth portion 11, it is easy to compress and deform the connecting portion in the direction of the bottle axis O so as to narrow the groove width of the first circumferential groove 30 over the entire circumference, and it is possible to reliably improve the buckling strength.

Further, since the main groove 18 is formed at the position avoiding the vertical rib region 2*a* between the upper body portion 14 and the lower body portion 15, when a large axial force in the compression direction is applied to the mouth portion 11, it is possible to compress and deform the body portion 12 in the direction of the bottle axis O so as to narrow the groove width of the main groove 18, it is easy to uniformly compress and deform the body portion 12 in the direction of the bottle axis O over the entire circumference in cooperation with the formation of the first circumferential groove 30 in a portion of the lower body portion 15 located in the vertical rib region 2*a*, and it is possible to suppress the upper body portion 14 from being inclined to fall forward with respect to the lower body portion 15.

In addition, since the first circumferential groove 30 is disposed at a position avoiding a portion of the bottle 2 along the circumferential direction in which the main groove 18 is located, when a large axial force in the compression direction is applied to the mouth portion 11, it is possible to easily and uniformly compress and deform the body portion 12 in the direction of the bottle axis O over the entire circumference.

Further, the handle 3 is disposed in the recessed portion 16 formed in the rear part of the upper body portion 14, and when a large axial force in the compression direction is applied to the mouth portion 11, since the rib effect of the handle 3 is easily exerted, it is possible to remarkably exert the aforementioned action and effect.

Further, since both end portions of the main groove 18 in the circumferential direction are opened to the recessed portion 16, when a large axial force in the compression direction is applied to the mouth portion 11, the body portion 12 can be reliably compressed and deformed in the direction of the bottle axis O so as to narrow the width of the main groove 18.

The technical scope of the present invention is not limited to the aforementioned embodiments, and various modifications can be made within the scope that does not depart from the gist of the present invention.

For example, in the above-described embodiment, a configuration having a rectangular shape in the cross-sectional view has been described as the lower body portion 15, but the present invention is not limited thereto. For example, the lower body portion 15 may be appropriately changed to another angular shape, a circular shape or the like.

Further, the bottle 2 and the handle 3 may be integrally formed.

Further, the first circumferential groove 30 may be disposed only on the rear wall 22, without being disposed on the side wall 23 of the lower body portion 15.

Further, the first circumferential groove 30 may be provided only in a portion of the rear wall 22 located in the vertical rib region 2*a*.

Further, the first circumferential groove 30 may be disposed only in the angular plate portion 25, without being disposed on the main plate portion 24 of the side wall 23.

Further, the main groove 18 and the recessed portion 16 may not be formed in the body portion 12.

Further, it is not necessary to open both end portions of the main groove 18 in the circumferential direction to the recessed portion 16.

The synthetic resin material forming the bottle 2 may be appropriately changed, for example, to polyethylene terephthalate, polyethylene naphthalate, amorphous polyester, blended materials thereof, or the like.

Furthermore, the bottle 2 is not limited to a single layer structure, and may be a laminated structure having an intermediate layer. As the intermediate layer, for example, a layer made of a resin material having gas barrier properties, a layer made of a recycled material, a layer made of a resin material having oxygen absorbability, and the like can be mentioned.

Besides, within the scope that does not depart from the gist of the present invention, it is possible to appropriately replace the constituent elements in the aforementioned embodiment with well-known constituent elements, and the above modified example may be combined as appropriate.

INDUSTRIAL APPLICABILITY

According to the present invention, when a large axial force in the compression direction is applied to the mouth portion, it is possible to suppress the upper body portion from being inclined to fall forward with respect to the lower body portion.

While preferred embodiments of the invention have been described and illustrated above, it should be understood that these are exemplary of the invention and are not to be considered as limiting. Additions, omissions, substitutions, and other modifications can be made without departing from the spirit or scope of the present invention. Accordingly, the invention is not to be considered as being limited by the foregoing description, and is only limited by the scope of the appended claims.

REFERENCE SIGNS LIST

1 bottle with handle
2 bottle
2*a* vertical rib region (portion of bottle along circumferential direction in which handle is located)
3 handle
11 mouth portion
12 body portion
13 bottom portion
14 upper body portion
15 lower body portion
16 recessed portion
18 main groove (second circumferential groove)
21 front wall
22 rear wall
23 side wall
24 main plate portion
25 angular plate portions
30 first circumferential groove
O bottle axis

What is claimed is:

1. A bottle with a handle comprising a mouth portion, a body portion, and a bottom portion that are continuously provided in this order along a direction of a bottle axis, and the handle disposed on the body portion, wherein:

a lower body portion of the body portion includes a front wall, a rear wall, and left and right side walls, and has a rectangular shape in a cross sectional view orthogonal to the bottle axis, the lower body portion located between the handle and the bottom portion along the direction of the bottle axis, each of the side walls includes a main plate portion, and front and rear angular plate portions, the front and rear angular plate portions separately connect the main plate portion of each of the side walls, the front wall, and the rear wall, a first circumferential groove and a first horizontal groove extending in a circumferential direction about the bottle axis are formed in the rear wall such that the first circumferential groove and the first horizontal groove are disposed over an entire region in the circumferential direction of a portion of the bottle along the circumferential direction in which the handle is located, among inner surfaces defining the first circumferential groove, an upper surface located on an upper side and facing downward has an inclination angle with respect to a horizontal plane orthogonal to the bottle axis that is smaller than that of a lower surface located on a lower side and facing upward, a second circumferential groove extending in the circumferential direction is formed between an upper body portion of the body portion, in which the handle is disposed, and the lower body portion, at a position avoiding a portion of the bottle along the circumferential direction in which the handle is positioned, the body portion includes a stepped portion which connects an upper end portion of the lower body portion and on which a lower end portion of the handle abuts, the first circumferential groove extends from the rear wall to the main plate portion of each of the side walls through the rear angular plate portion of each of the side walls, and the first horizontal groove does not extend to the rear angular plate portion of either of the side walls.

2. The bottle with the handle according to claim 1, wherein a recessed portion which is recessed forward and in which the handle is disposed is formed in a rear part of the upper body portion, and each of both end portions of the second circumferential groove in the circumferential direction is opened to the recessed portion.

3. The bottle with the handle according to claim 1, wherein a groove width of the first circumferential groove is narrower than a groove width of the second circumferential groove, and a depth of the first circumferential groove is shallower than a depth of the second circumferential groove.

4. The bottle with the handle according to claim 1, wherein, among inner surfaces defining the first circumferential groove, a bottom surface positioned at an inner end portion in a radial direction of the bottle and facing outward in the radial direction is formed in a concave curved surface shape recessed inward in the radial direction.

5. The bottle with the handle according to claim 1, wherein a depth of the first circumferential groove is deeper than a depth of the first horizontal groove.

6. The bottle with the handle according to claim 1, wherein the first circumferential groove is formed on a lower side of the bottle than the first horizontal groove.

* * * * *